US007254981B2

(12) United States Patent
Ishizuka et al.

(10) Patent No.: US 7,254,981 B2
(45) Date of Patent: Aug. 14, 2007

(54) CRIMPING APPARATUS

(75) Inventors: Kazuharu Ishizuka, Chiba (JP); Hiromi Tanaka, Tokyo (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 378 days.

(21) Appl. No.: 10/933,869

(22) Filed: Sep. 3, 2004

(65) Prior Publication Data

US 2005/0050940 A1 Mar. 10, 2005

(30) Foreign Application Priority Data

Sep. 4, 2003 (JP) ..... 2003-312872

(51) Int. Cl.
*B21D 37/00* (2006.01)

(52) U.S. Cl. ..... 72/413; 72/446; 72/481.1

(58) Field of Classification Search ..... 72/481.1, 72/446, 441, 478, 480, 481.3, 473, 413; 29/753; 83/699.51, 699.61
See application file for complete search history.

(56) References Cited

U.S. PATENT DOCUMENTS 3,091,276 A * 5/1963 Aquillon ..... 29/753
6,622,254 B1 9/2003 Kao ..... 713/500
2005/0034505 A1* 2/2005 Imai et al. ..... 72/481.1

FOREIGN PATENT DOCUMENTS

| | | | |
|---|---|---|---|
| JP | S57-18280 | | 1/1982 |
| JP | 4-55790 | | 5/1992 |
| JP | 04-55790 | * | 5/1992 |
| JP | 07-006849 | | 1/1995 |
| JP | 07-27086 | | 5/1995 |
| JP | 09-115638 | * | 2/1997 |
| JP | 09-115638 | | 5/1997 |

* cited by examiner

*Primary Examiner*—Derris H. Banks
*Assistant Examiner*—Debra M Wolfe
(74) *Attorney, Agent, or Firm*—Barley Snyder LLC

(57) ABSTRACT

The present invention provides a crimping apparatus that can adapt widely to various diameters of the insulating coatings of wires. The crimping apparatus has a crimp height adjustment mechanism for an insulating coating of a wire, the front of the crimping apparatus facing in a direction opposite to the direction of a core of the wire. The adjustment mechanism includes a shaft member having a regular polygon part and an eccentric shaft part that are connected thereto, and an adjustment dial which is disposed in the eccentric shaft part so as to face in the same direction as the front of the crimping apparatus. Therefore, this crimping apparatus can perform the crimping of terminals having various diameters of the insulating coatings of wires.

8 Claims, 9 Drawing Sheets

PRIOR ART

PRIOR ART

CRIMPING APPARATUS

FIELD OF THE INVENTION

The present invention relates to a crimping apparatus that has adjustment mechanisms that adjust the crimping heights for a core and an insulating coating, respectively, of a wire with a stripped end, when a terminal is crimped onto the core and the insulating coating.

BACKGROUND OF THE INVENTION

A conventional crimping apparatus that has mechanisms that adjust the crimp heights for a core and an insulating coating of a wire when a terminal is crimped onto the core and the insulating coating (see Japanese Patent Laid-Open No. 7-6849, for example).

However, the crimping apparatus disclosed in Japanese Patent Laid-Open No. 7-6849 has a problem. Specifically, operating the crimp height adjustment mechanism for a core and the crimp height adjustment mechanism for an insulating coating involves additional operations, such as loosening of a predetermined fastened part, so that it takes time to adjust the crimp heights.

Thus, in order to solve this problem, a crimping apparatus has been proposed that has two dials for operating the two adjustment mechanisms (see Japanese Utility Model Laid-Open No. 7-27086, for example).

FIG. 1 is a front view of the essential parts of the crimping apparatus described in Japanese Utility Model Laid-Open No. 7-27086.

A crimping apparatus 1 described in Japanese Utility Model Laid-Open No. 7-27086 has, on the front thereof, dials 40, 50 for operating the crimp height adjustment mechanism for a core and the crimp height adjustment mechanism for an insulating coating and includes a prime mover section that produces a force required for crimping and an applicator 20 that achieves crimping of a terminal using the force produced by the prime mover section.

FIG. 1 shows an applicator 20 and a press ram 11 that is a component of the prime mover section which transmits the force produced by the prime mover section to the applicator 20.

The applicator 20 is composed of a machine casing 21, an anvil unit 22 and a base 23. A pair of vertical rails 24 is fixed to the machine casing 21, and an oscillation beam 26 is supported on the machine casing 21 by a shaft 26*a*. A tool ram 25, which crimps a terminal onto a stripped part 30*a* of a wire 30 (see FIG. 2) in cooperation with the anvil unit 22, is guided by the vertical rails 24 to move up and down.

The tool ram 25 is connected to the press ram 11 described above and has a cam roller 25*b* supported on a side section 25*a* thereof by a shaft 25*c*, and the cam roller 25*b* is fitted into a cam groove 26*b* formed in the oscillation beam 26. Thus, when the tool ram 25 moves up and down, the oscillation beam 26 oscillates about the shaft 26*a*. A plate 28 is attached to a lower part of the oscillation beam 26, and a feeding claw 27, whose tip end engages with chained terminals n placed behind a terminal guide rail 23*a*, is supported on the plate 28 by a shaft 27*b*.

The press ram 11 has a standard dial 111 that adjusts the bottom dead center of a bottom end 11*a*.

FIG. 2 is a side view of the essential parts of the crimping apparatus shown in FIG. 1.

A terminal n1 shown in FIG. 2 is composed of a contact part n11, an insulation barrel n12 for holding the coating 31 of the wire 30, and a wire barrel n13 for holding a core 32 of the wire 30. Multiple terminals n1 are connected to a carrier n14 to constitute the chained terminals n. A crimper section 25*d* of the tool ram 25 shown also in FIG. 1 is composed of a cut-off punch 251*d*, an insulator crimper 252*d* for crimping the insulation barrel n12, and a wire crimper 253*d* for crimping the wire barrel n13.

In this crimping apparatus 1, operation of a feeding claw 27 causes the terminal n1, which is the closest to the anvil unit 22 of the plural chained terminals n, to be placed on the anvil unit 22. Then, when the wire 30 with an end at which a stripped part 30*a* is previously formed is placed on the terminal n1 on the anvil unit 22, the press ram 11 moves downward, and the tool ram 25 connected to the press ram 11 is guided by the vertical rails 24 to move downward. Then, the tool ram 25 and the anvil unit 22 cooperate to cut a bridge part n15, which connects the terminal to the carrier n14, and crimp the terminal n1, separated from the chained terminals n, onto the stripped part 30*a*. When the crimping is completed and the tool ram 25 begins to move upward, the cam roller 25*b* also moves upward along the cam groove 26*b* in the oscillation beam 26, and thus, the oscillation beam 26 oscillates about the shaft 26*a* counterclockwise. This movement causes the feeding claw 27 to place a terminal, which is the closest to the anvil unit 22 of the chained terminals n, on the anvil unit 22 along the terminal guide rail 23*a*.

As shown in FIG. 2, the anvil unit 22 is composed of a floating shear 221 having a groove cutting edge 221*a*, an insulation anvil 222 and a wire anvil 223. When the tool ram 25 moves downward guided by the vertical rails 24, the bridge part n15 of the terminal n1 on the anvil unit 22 is cut by the cut-off punch 251*d* and the groove cutting edge 221*a* of the floating shear 221, and the insulation barrel n12 is crimped onto the coating 31 of the wire 30 by the insulation crimper 252*d* and the insulation anvil 222. In addition, the wire barrel n13 is crimped onto the stripped core 32 of the wire 30 by the wire crimper 253*d* and the wire anvil 223.

Here, in the crimping apparatus 1 shown in FIGS. 1 and 2, the crimp heights for the core and the coating are adjusted by changing the bottom dead centers of the wire crimper 253*d* and the insulation crimper 252*d*, respectively, by use of a lower dial 40 and an upper dial 50 after the adjustment by the standard dial 111 provided in the press ram. In FIGS. 1 and 2, the upper dial 50 is for the wire crimper and the lower dial 40 is for the insulator crimper.

There are various types of wires according to their applications. For example, in the crimping apparatus described in Japanese Utility Model Laid-Open No. 7-27086, when terminal crimping is to be performed for multiple kinds of wires the coating diameter of which differs greatly though the core diameter thereof is the same, it may sometimes become impossible to adapt to various kinds of wires if only the adjustment of the bottom dead center of the insulation crimper by the turning of the dial 40 for the insulation crimper is performed.

In view of such circumstances, the present invention has as its object the provision of a crimping apparatus that can adapt widely to various diameters of the insulating coatings of wires.

SUMMARY OF THE INVENTION

In view of the above problems, the present, in an exemplary embodiment, provides a crimping apparatus that can adapt widely to various diameters of the insulating coatings of wires. The exemplary crimping apparatus has a crimp height adjustment mechanism for an insulating coating of a wire, the front of the crimping apparatus facing in a direction opposite to the direction of a core of the wire. The adjustment mechanism includes a shaft member having a regular polygon part and an eccentric shaft part that are connected thereto, and an adjustment dial which is disposed in the eccentric shaft part so as to face in the same direction as the front of the crimping apparatus.

DETAILED DESCRIPTION OF THE INVENTION

Now, embodiments of the present invention will be described below.

Figure 3:
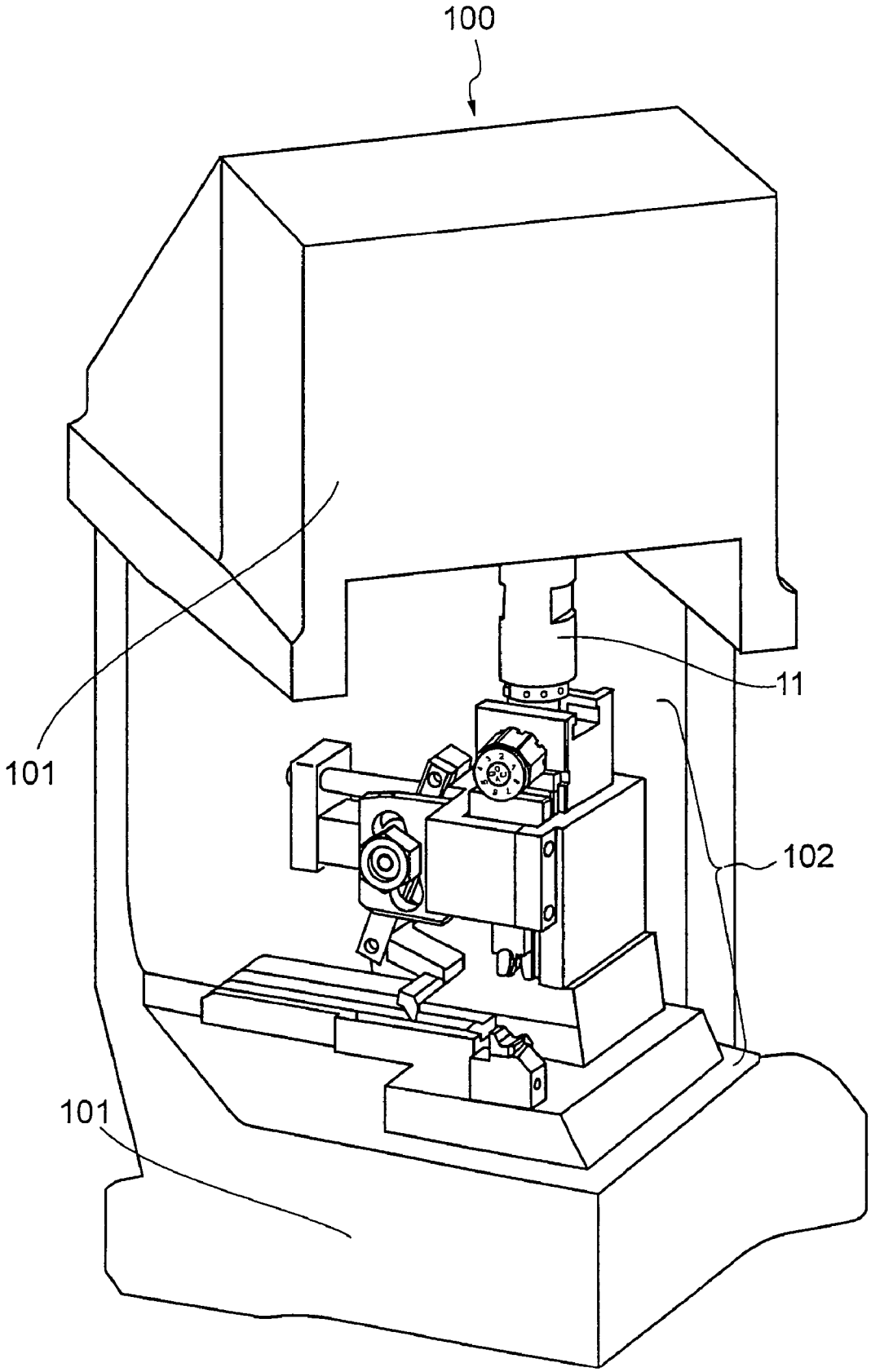
FIG. 3 is a perspective view of a crimping apparatus according to an embodiment of the present invention.

A crimping apparatus 100 according to an exemplary embodiment of the present invention is shown in FIG. 3. The crimping apparatus 100 has a housing section 101 that contains a prime mover that drives a press ram 11, and an applicator section 102 that is attached to the housing section 101 and crimps a terminal onto a stripped end part of a wire using the force from the press ram 11. FIG. 3 also shows an insulation dial that is provided on the upper end of the applicator section 102 and performs the adjustment of the bottom dead center of an insulation crimper. Incidentally, a standard dial that adjusts the bottom dead center of the press ram 11 is provided within the housing section 101 above the press ram 11.

Figure 4:
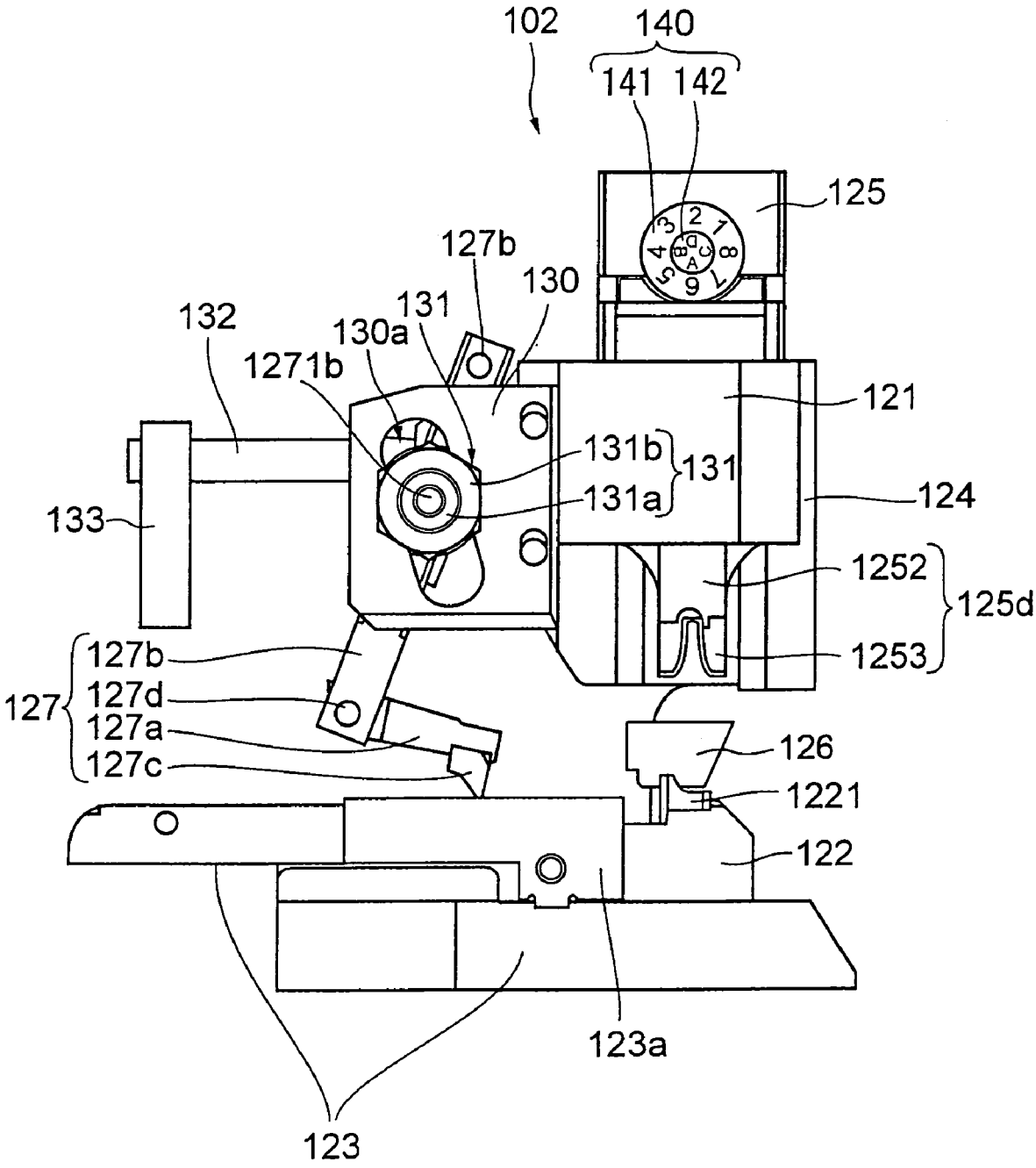
FIG. 4 is a front view of an applicator section of the crimping apparatus shown in FIG. 3.

A terminal (not shown) is fed into the applicator section 102 shown in FIG. 4, from the left in the drawing, and a wire (not shown) with an end stripped to expose the core is fed thereto from the front in the drawing. As described in detail later, in the applicator 102, the crimp height of the core is adjusted by the above-described standard dial and the crimp height of the insulating coating is basically adjusted first by the above-described standard dial and then further adjusted by an insulation dial 140 shown in FIG. 4. This insulation dial 140 is composed of a main dial 142, which is provided at the center and roughly adjusts the bottom dead center, and a sub dial 141, which is provided along the peripheral part of the main dial 142 and finely adjusts the bottom dead center.

The applicator section 102 shown in FIG. 4 essentially has a machine casing 121, a tool ram 125 that moves up and down with respect to the machine casing 121, an anvil unit 122, and a base 123. The machine casing 121 has a vertical rail 124 attached thereto, along which the tool ram 125 moves up and down.

In addition, the machine casing 121 has a side plate 130 with an elongated hole 130*a* formed therein. In addition, a shaft 132 is provided between the machine casing 121 and a supporting member 133 attached to the housing section 101 (see FIG. 3) located to the left in FIG. 4.

The shaft 132 has a cam follower (not shown) provided thereon, which engages with a cam groove formed in a predetermined surface of the tool ram 125 to allow the shaft 132 to reciprocate in a horizontal direction in FIG. 4 in response to the tool ram 125 moving up and down.

A claw section 127 feeds one of the chained terminals n which is the closest to the anvil unit 122 to the anvil unit 122, and an arm 127*b* of the claw section 127 is connected to the shaft 132 and has a shaft 1271*b* passing through the elongated hole 130*a*. The side plate 130 has a composite nut 131 having a center section 131*a* and a peripheral section 131*b* attached thereto at the center of the elongated hole 130*a*. An end of the shaft 1271*b* of the arm 127*b* is press-fitted to the center section 131*a* of the composite nut 131. The center section 131*a* of the composite nut 131 can rotate with respect to the peripheral section 131*b*. Thus, when the shaft 132 moves in a horizontal direction in FIG. 4 in response to the tool ram 125 moving up and down, the arm 127*b* rotates about the center section 131*a* of the composite nut 131 to move a claw 127*c* via a link section 127*a* connected thereto, and the claw 127*c* feeds a terminal to the anvil unit 122.

In addition, FIG. 4 shows a crimper section 125*d* for achieving crimping in cooperation with the anvil unit 122 that is located directly below the insulation dial 140 shown near the upper end of the tool ram 125 and composed of a cut-off punch 1252 and an insulation crimper 1253 and the like.

The anvil unit 122 has a floating shear 1221 that separates a leading one from the chained terminals in cooperation with the cut-off punch 1252, as well as an insulation anvil that achieves crimping in cooperation with the insulation crimper 1253 or the like, although the insulation anvil is not shown in FIG. 4. Furthermore, FIG. 4 shows an abutment plate 126 located above the anvil unit 122, against which the tip end of the core of the stripped wire abuts for positioning of the wire.

Figure 5:
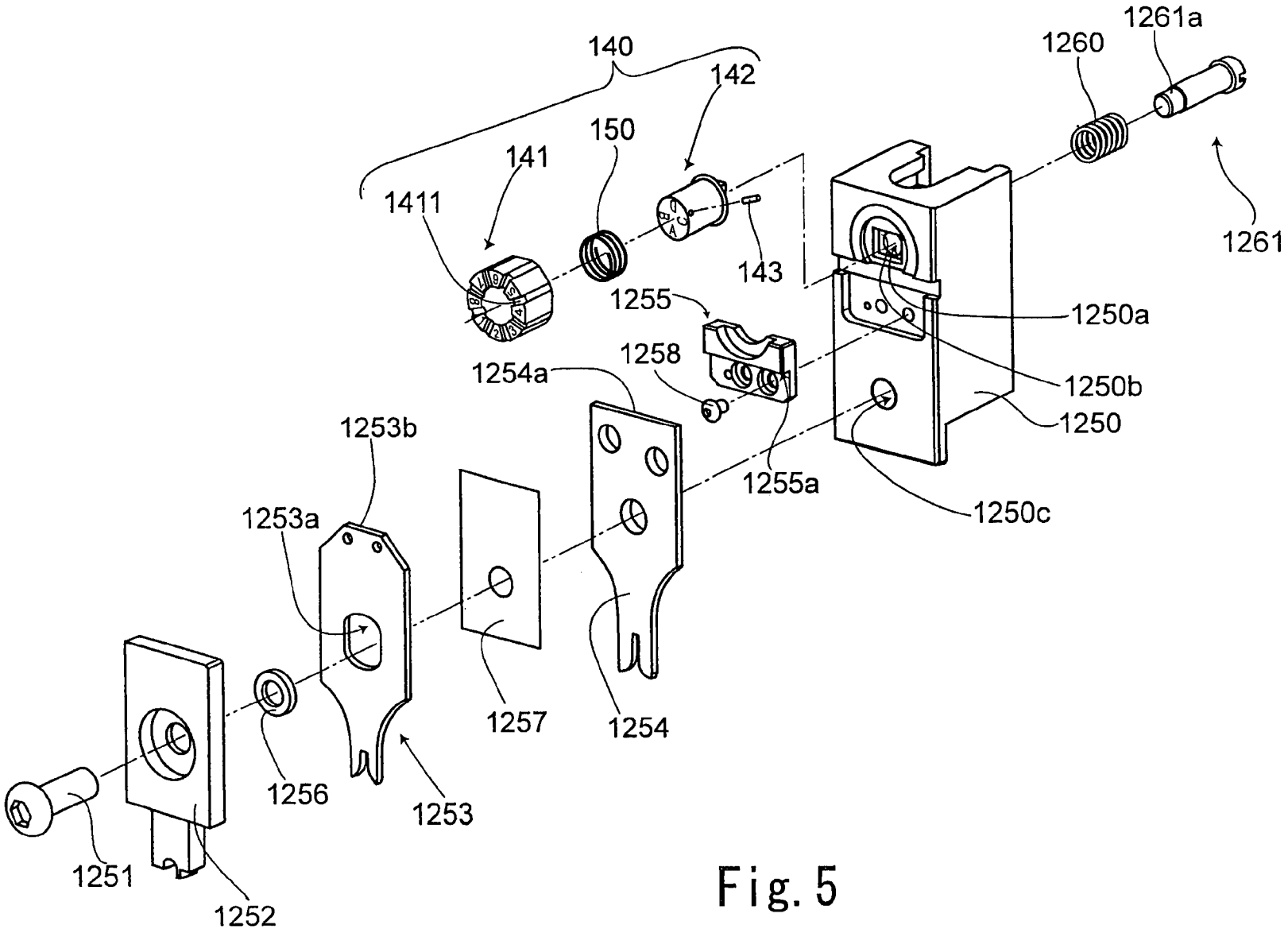
FIG. 5 is an exploded view of a tool ram.

FIG. 5 shows components of the tool ram 125. In the lower left area of FIG. 5, there are shown the cut-off punch 1252, a flat washer 1256, the insulation crimper 1253, a spacer 1257 and a wire crimper 1254, which are attached by a hexagonal screw 1251 to a lower part of a main section 1250 of the tool ram 125. FIG. 5 also shows a crimper support 1255 that is attached to the middle of the main section 1250 by a screw 1258. In FIG. 5 there is also shown a rotary shaft 1261 that passes through a spring 1260 and is fitted into a hole 1250*a* formed in the upper part of the main section 1250. A leading end portion 1261*a* of the rotary shaft 1261 has a screw thread. This rotary shaft 1261 is fitted from the back side of the main section 1250 of the tool ram 125, compressing the spring 1260, and the leading end portion 1261*a* thereof is screwed into the main dial 142 of the insulation dial 140. The sub dial 141 is fitted onto this main dial 142 that passes through a spring 150, and the sub dial 141 is prevented from turning back by a pin 143, which is attached to the leading end of the main dial 142, with the spring 150 compressed. That is, the main dial 142 is held toward the main section 1250 and the sub dial 141 is prevented by the pin 143 from moving away from the main dial 142. The pin 143 is fitted into a concavity 1411 provided between numeric FIGS. (1 to 8) written on the front of the sub dial 141 (see FIG. 8). As a result, the position of the sub dial 141 with respect to the main dial 142 is fixed.

In the tool ram 125, an upper edge 1254*a* of the wire crimper 1254 abuts against the bottom of a jaw 1255*a* of the crimper support 1255. The flat washer 1256 is thicker than the insulation crimper 1253 and is fitted into an elongated hole 1253*a* formed in the middle of the insulation crimper 1253. Thus, the insulation crimper 1253 can move vertically with respect to the main section 1250.

The insulation dial 140 is, as described above, composed of the main dial 142 and the sub dial 141, and the sub dial 141 is a short component having a substantially cylindrical shape and has a polygon outer circumference. While the distance between the center axis and the inner circumference of the sub dial 141 is constant, the distance between the center axis and the outer circumference varies with the position along the circumference. That is, the thickness of the sub dial 141 varies with the point along the circumference.

Figure 6:
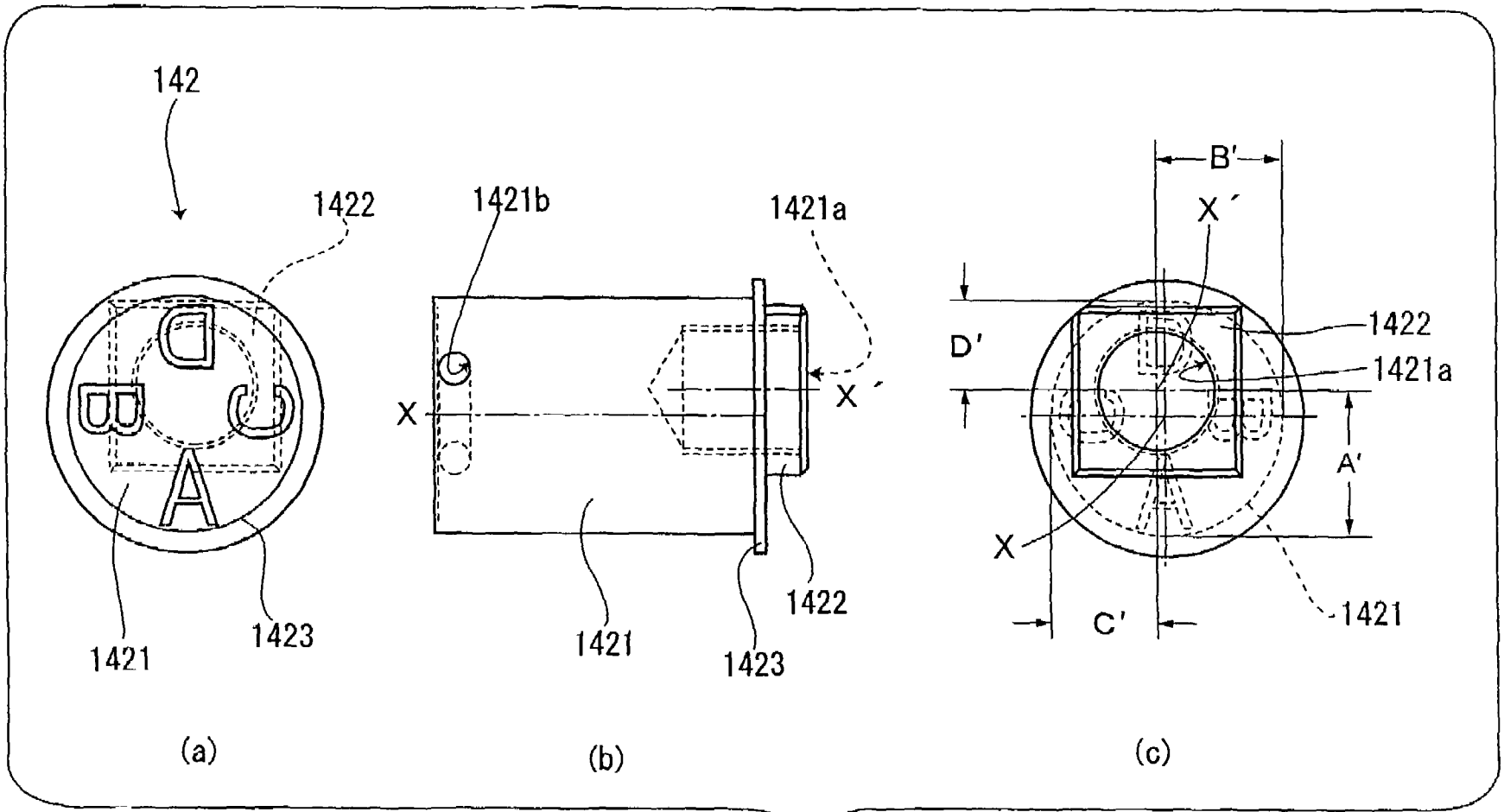
FIG. 6 is a drawing which shows a main dial.

As shown in FIG. 6, the main dial 142 is composed of an eccentric part (an eccentric shaft part) 1421, a fitted part (a regular polygon part) 1422 and a flange 1423 sandwiched between them.

FIG. 6 shows the main dial 142 in detail. Part (a) of FIG. 6 is a front view of the main dial 142, and the square-shaped fitted part 1422 on the back side is indicated by dotted lines. Part (b) of FIG. 6 is a right side view of the main dial 142, and there is shown a hole 1421*a*, in which is provided a screw groove which engages with a screw thread provided in the leading end portion 1261*a* of the rotary shaft 1261 shown in FIG. 5.

Part (c) of FIG. 6 is a back surface view of the main dial 142 and shows the eccentric part 1421 by dotted lines. The center axis X of the eccentric part 1421 of the main dial 142 and the center axis X' of the fitted part 1422 of the main dial 142 shift from each other, and this fitted part 1422 is fitted into a square concavity 1250*b*, which is formed so as to surround a hole 1250*a*, by the biasing force of the spring 1260 to the main section 1250 side. In this applicator section 102, the main dial 142 to which the pin 143 is attached is also pulled together against the biasing force of the spring 1260 when the sub dial 141 is pulled so as to be away from the main section 1250 and, therefore, the fitted part 1422 comes free from the concavity 1250*b* to be rotatable with respect to the center axis X'. At this time, when the main dial 142 is rotated so that the letter "A" written on the main dial 142 comes to the lower side of Part (a) of FIG. 6, that is, to the lower side of the main section 1250 shown in FIG. 5, the main dial 142 comes to the lowest position with respect to the main section 1250. Also, by counterclockwise rotation of the main dial by 90 degrees from this state so that the letter "B" comes to the lower side, it is possible to locate the main dial 142 with respect to the main section 1250 in a raised position compared to the case where the letter "A" comes to the lower side. When the letter "C" is caused to come to the lower side, the position of the main dial 142 rises more. When the letter "D" is caused to come to the lower side, the position of the main dial 142 with respect to the main section 1250 further rises.

In Part (c) of FIG. 6, the distance from the center axis X' of the fitted part 1422 to the lowest end of the eccentric part 1421 when each of the letters "A," "B," "C" and "D" comes to the lower side is indicated by "A'," "B'," "C'" and "D'," respectively. The distance of "A'" is the longest and the distance of "D'" is the shortest.

Figure 7:
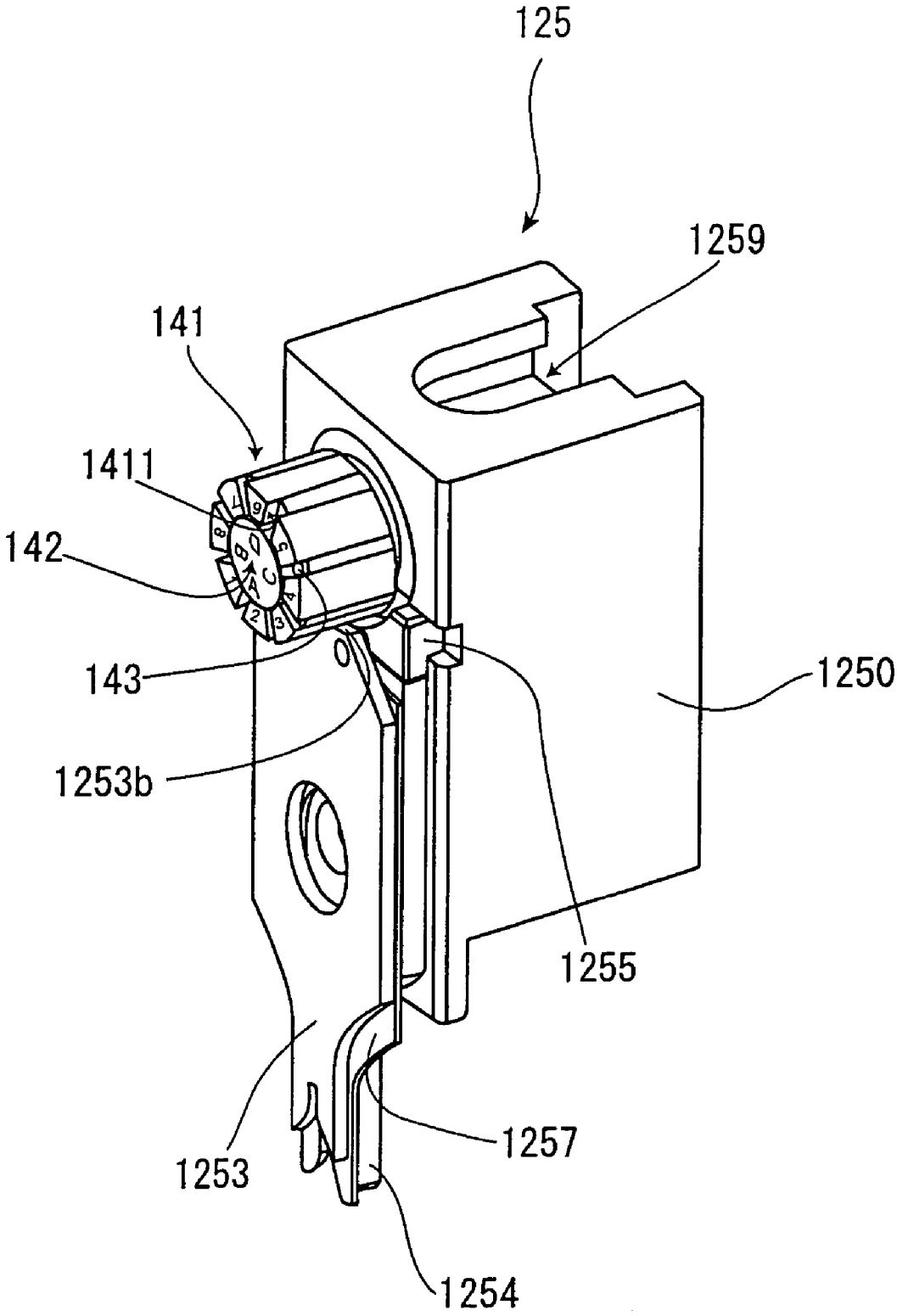
FIG. 7 is a perspective view of the tool ram.
Figure 8:
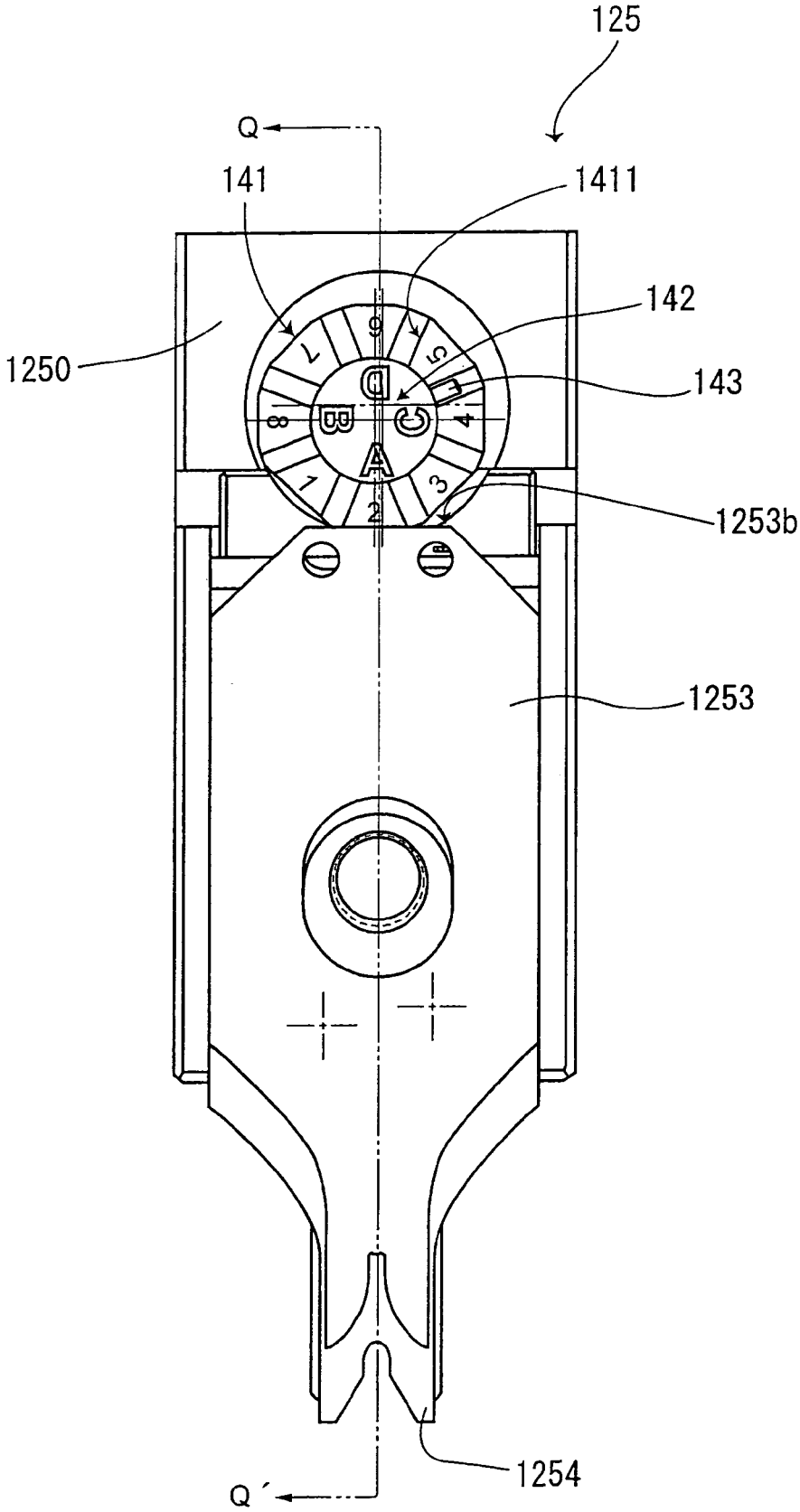
FIG. 8 is a front view of the tool ram.

FIG. 7 is a perspective view of the tool ram 125 and FIG. 8 is a front view of the tool ram 125. Incidentally, in order to avoid the complication of illustration, the illustrations of the hexagonal screw 1251, cut-off punch 1252, flat washer 1256, etc. shown in FIG. 5 are omitted here.

FIGS. 7 and 8 show how the lowest surface of the sub dial 141 that is fitted over the main dial 142 is opposed to an upper surface 1253*b* of the insulation crimper 1253.

Numeric figures "1" to "8" are written on the front of the sub dial 141 and, as described above, the sub dial 141 has a polygon outer circumference. While the distance between the center axis and the inner circumference of the sub dial 141 is constant, the distance between the center axis and the outer circumference varies with the position along the circumference. In the applicator section 102, the thickness of the sub dial 141 varies with the point along the circumference. Therefore, when the numeric figure "8" on the sub dial 141 is brought to the lowest position after the letter "A" on the main dial 142 is brought to the lowest position, the lower edge of the sub dial 141 comes to the lowest position with respect to the main section 1250 of the tool ram 125. And, when the numeric figure "1" on the sub dial 141 is brought to the lowest position after the letter "D" on the main dial 142 is brought to the lowest position, the lower edge of the sub dial 141 comes to the highest position with respect to the main section 1250 of the tool ram 125. That is, in this applicator 102, it is possible to change the bottom dead center of the insulation crimper 1253, including the above-described highest and lowest positions, in 32 different ways.

Figure 9:
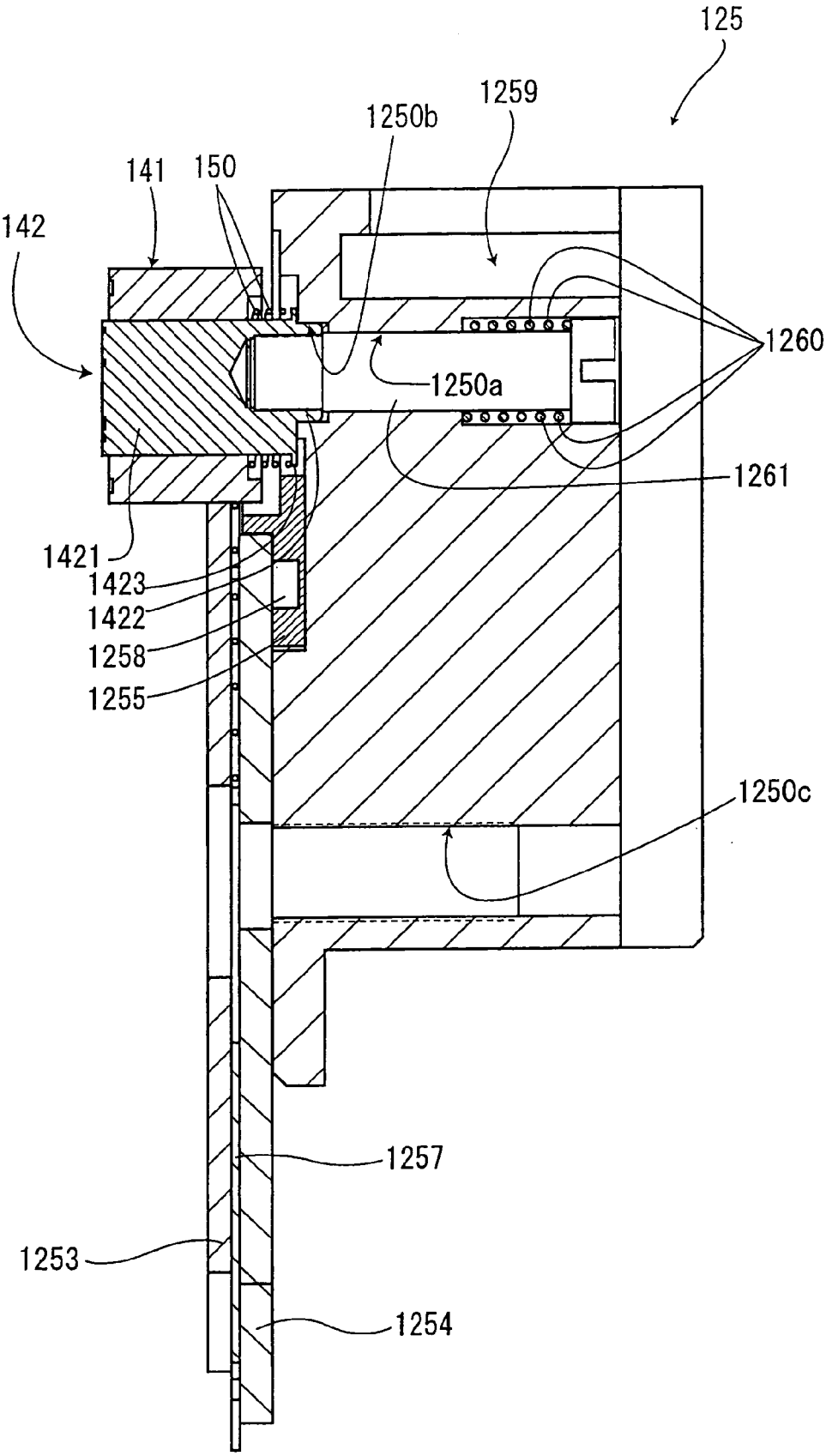
FIG. 9 is a sectional view of the tool ram taken along the line Q-Q' of FIG. 8.

The rotation of the sub dial 141 is performed after disengagement from the fitting of the pin 143 attached to the main dial 142 into the concavity 1411 provided on the sub dial 141 while pressing this sub dial 141 to the main section 1250 side shown in FIG. 8 against the biasing force of the spring 150 shown in FIG. 9.

Next, the crimping action by the crimping apparatus 100 according to this embodiment will be described. In the crimping apparatus 100, the tool ram 125 moves up and down in response to the press ram 11 (see FIG. 3), which is movably provided in a space 1259 (see FIG. 7) above the tool ram 125, moving up and down. When the press ram 11 moves down, the insulation crimper 1253 and wire crimper 1254 of the tool ram 125 suspended from the press ram 11 come into contact with the terminal placed under the crimpers, and thus, the press ram 11 moving downward decelerates. Then, the press ram 11 continues to move downward until it reaches a predetermined bottom dead center, and thus, the tool ram 125 is pressed to the anvil unit 122 side according to a graduation selected by the standard dial. In this process, the terminal is crimped onto the stripped part of the wire. Thus, the crimp height for the coating of the wire and the crimp height for the core of the wire are adjusted by adjusting the bottom end dead centers of the insulation crimper 1253 and the wire crimper 1254, respectively, that are responsible for crimping.

Figure 1:
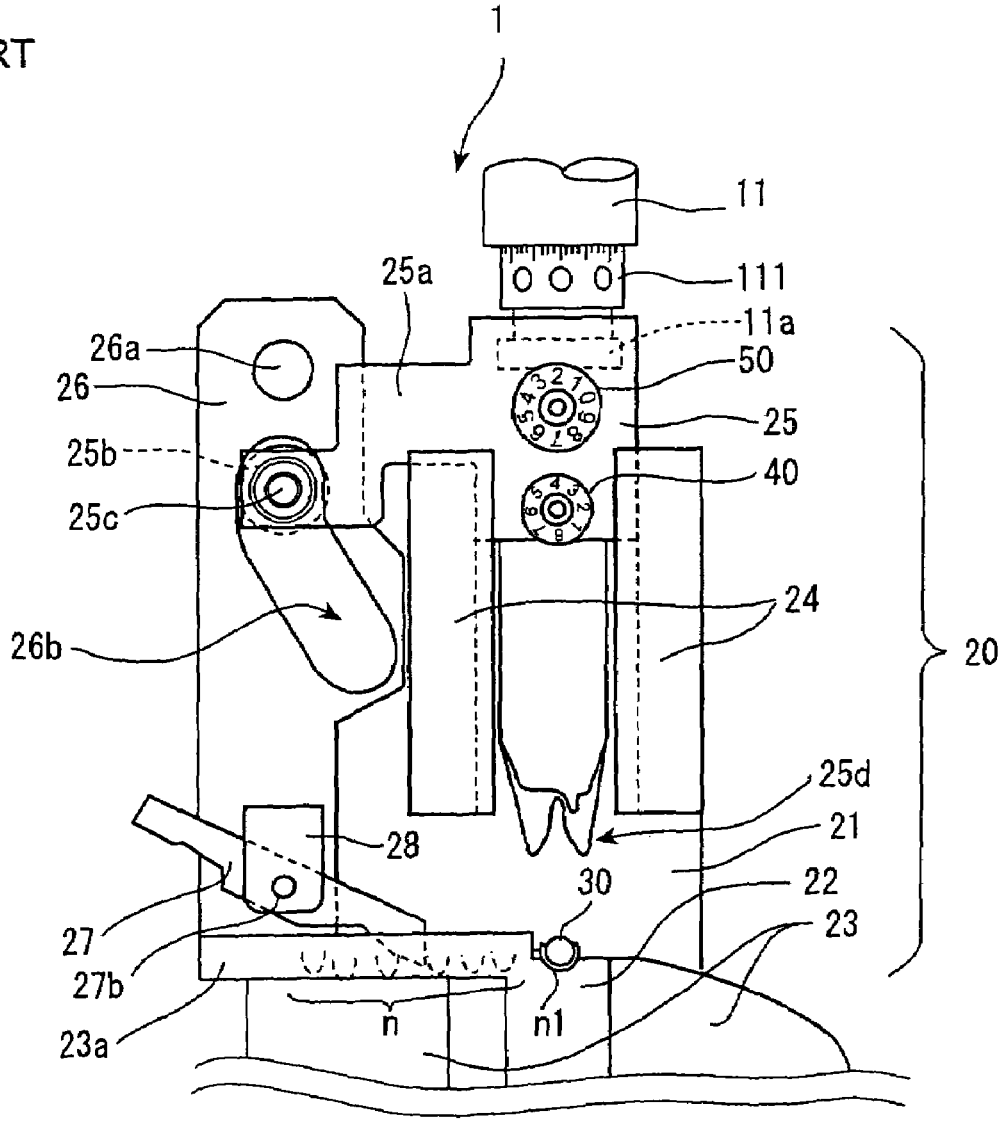
FIG. 1 is a front view of the essential parts of a crimping apparatus described in Japanese Utility Model Laid-Open No. 7-27086.
Figure 2:
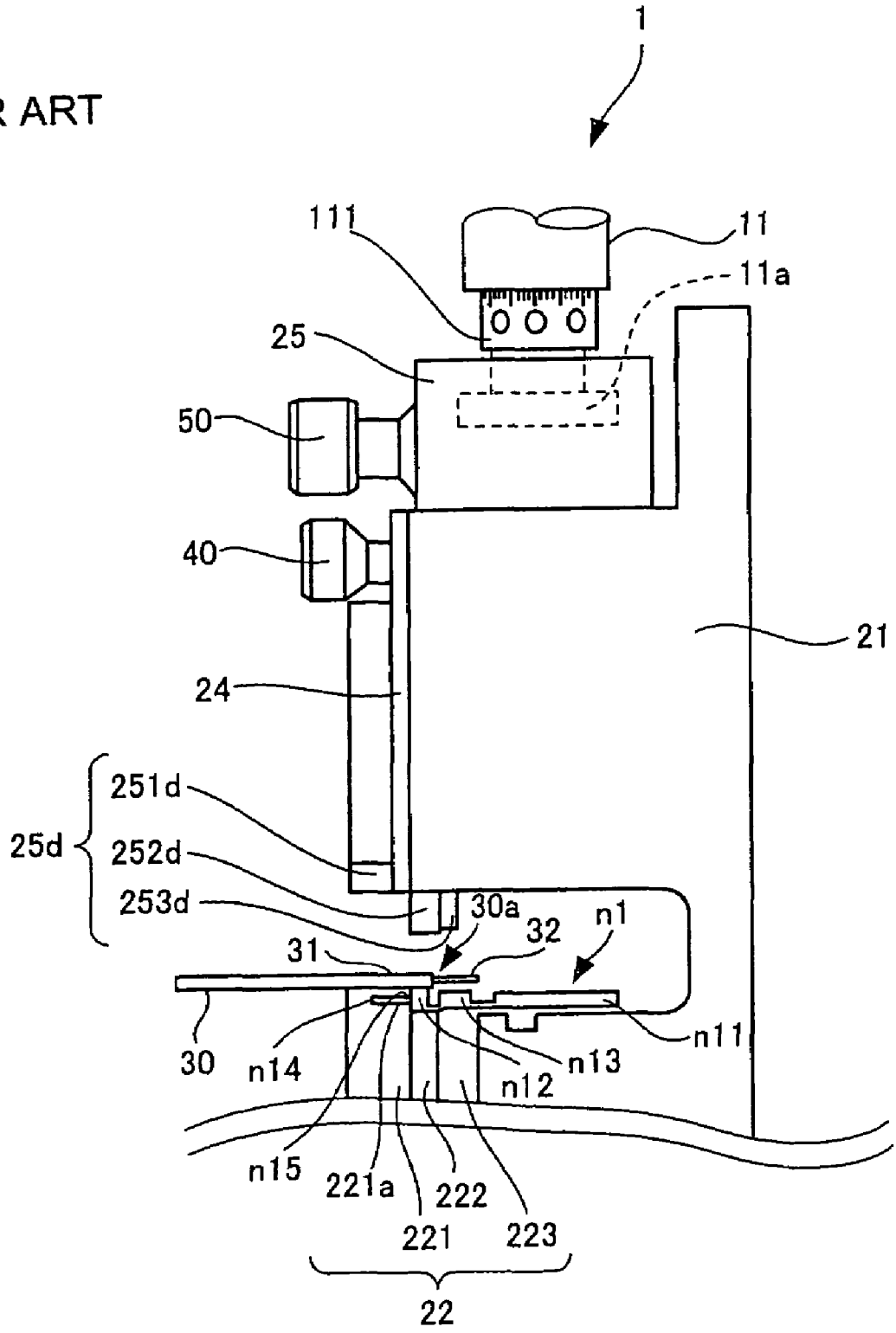
FIG. 2 is a side view of the essential parts of a crimping apparatus shown in FIG. 1.

The bottom dead center of the wire crimper 1254 for crimping of a wire barrel n13 (see FIG. 2) of the terminal is adjusted by the standard dial that adjusts the bottom dead center of the press ram, as described above.

The bottom dead center of the insulation crimper 1253 for crimping of an insulation barrel n12 (see FIG. 2) of the terminal can be adjusted in a wider range than conventional techniques by adjusting the main dial 142 and the sub dial 141 that constitute the insulation dial 140, as described above on the basis of the adjustment by the standard dial. In this way, the crimping apparatus 100 of this embodiment can be adapted to wires having substantially different diameters of insulating coatings.

Also, in the crimping apparatus 100 according to this embodiment described above, the dial for adjusting the bottom dead center of the insulation crimper 1253 is disposed so as to face the operator and, therefore, the adjustment work of the crimp height of the insulating coating can be easily performed. In addition, the adjustment work can be easily performed by pulling out the sub dial 141 when the bottom dead center of the insulation crimper 1253 is to be greatly changed and by pushing the sub dial 141 in when a fine adjustment is to be made.

Incidentally, in the above-described embodiment, the descriptions were made of the case where the fitted part 1422 is a square. In the present invention, however, it is acceptable so long as the fitted part 1422 is a regular polygon and, therefore, the fitted part 1422 may be an equilateral triangle, an equilateral pentagon or an equilateral octagon.

What is claimed is:

1. A crimping apparatus having a crimp height adjustment mechanism for an insulating coating of a wire, the front of the crimping apparatus facing in a direction opposite to the direction of a core of the wire, wherein the adjustment mechanism comprises a shaft member having a regular polygon part and an eccentric shaft part that is connected to the regular polygon part and that has a center axis that is offset from a center axis of the regular polygon part, and an adjustment dial which is disposed on the eccentric shaft part so as to face in the same direction as the front of the crimping apparatus and which has a polygon outer circumference, the adjustment dial being disposed to operatively abut an insulation crimper on one side of the polygon outer circumference.

2. The crimping apparatus of claim 1, wherein the crimp height adjustment is positioned on an applicator that is operatively associated with a press ram.

3. The crimping apparatus of claim 2, wherein the applicator has a wire crimper having a bottom dead center position, the bottom dead center position being adjustable by a dial on the press ram.

4. The crimping apparatus of claim 3, wherein the wire crimper, at an upper edge thereof, abuts against a surface fixedly attached to the press ram.

5. The crimping apparatus of claim 1, wherein the distance between a center axis of the adjustment dial and the polygon outer circumference of the adjustment dial varies along the polygon outer circumference.

6. The crimping apparatus of claim 1, wherein the adjustment dial has a plurality of concavities positioned between successive sides thereof, the eccentric shaft part has a pin extending therefrom, and the adjustment dial is biased relative to the eccentric shaft part to engage the pin in one of the concavities.

7. The crimping apparatus of claim 2, wherein the regular polygon part is fitted into a matched concavity, in the applicator.

8. The crimping apparatus of claim 7, wherein the regular polygon part is biased into the matched concavity and configured to be retractable from the matched concavity to rotate the regular polygon part and the eccentric shaft part to adjust the height of the insulation crimper.

* * * * *